United States Patent [19]

Cimetiere et al.

[11] 4,117,880

[45] Oct. 3, 1978

[54] TENSIONLESS METALLIC BAND OF HIGH THERMAL CONDUCTIVITY IN A CONTINUOUS CASTING MACHINE

[75] Inventors: Louis Cimetiere, Meylan; Richard Gonda, Gieres, both of France

[73] Assignee: Societe de Vente de l'Aluminium Pechiney, Paris, France

[21] Appl. No.: 816,914

[22] Filed: Jul. 19, 1977

[30] Foreign Application Priority Data

Jul. 27, 1976 [FR] France ..... 76 23747

[51] Int. Cl.[2] ..... B22D 11/06

[52] U.S. Cl. ..... 164/433; 164/73

[58] Field of Search ..... 164/87, 429, 431–433, 164/73

[56] References Cited

U.S. PATENT DOCUMENTS

| | | | |
|---|---|---|---|
| 3,416,594 | 12/1968 | Gyongyos | 164/280 |
| 3,509,937 | 5/1970 | Radd | 164/87 |

FOREIGN PATENT DOCUMENTS

| | | | |
|---|---|---|---|
| 1,178,580 | 5/1959 | France | 164/433 |
| 1,143,264 | 2/1969 | United Kingdom | 164/433 |

*Primary Examiner*—Francis S. Husar
*Assistant Examiner*—John McQuane
*Attorney, Agent, or Firm*—Dennison, Dennison, Meserole & Pollack

[57] ABSTRACT

An improvement in casting machines in which the molten metal solidifies inside the groove of a wheel, consisting of replacing the steel band generally used for covering the groove by a double band. A first band of copper or of an alloy which is a good conductor of heat is used for dissipating heat but is not under any tension. The tension is provided by a steel band in two parts which bears on the sides of the copper band and keeps it in contact with the casting wheel. The invention applies in particular to the casting of blanks of charged aluminum alloys for the production of machine wire.

4 Claims, 8 Drawing Figures

TENSIONLESS METALLIC BAND OF HIGH THERMAL CONDUCTIVITY IN A CONTINUOUS CASTING MACHINE

This invention relates to an improvement in machines for continuously casting blanks on a grooved wheel.

The continuous casting of metal alloys, particularly aluminum alloys, on a rotating casting wheel covered by a band entrained by the wheel has long been known and has already given rise to several industrial processes. This casting principle has been applied above all to the casting of blanks intended for the production by rolling of machine wire. In this process the blank issuing hot from the casting wheel is guided towards a train of hot and then cold or warm rollers, at the output end of which the machine wire is wound, the assembly of operations taking place continuously in a single line.

In the drawings, FIGS. 1 through 4 illustrate the known prior art wherein:

Figure 3:
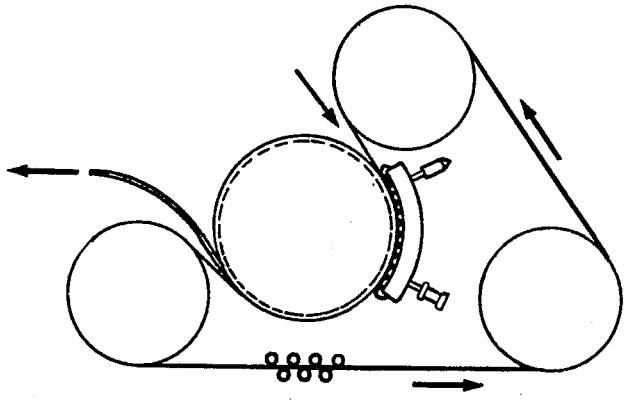
PRIOR ART FIG. 3
Figure 4:
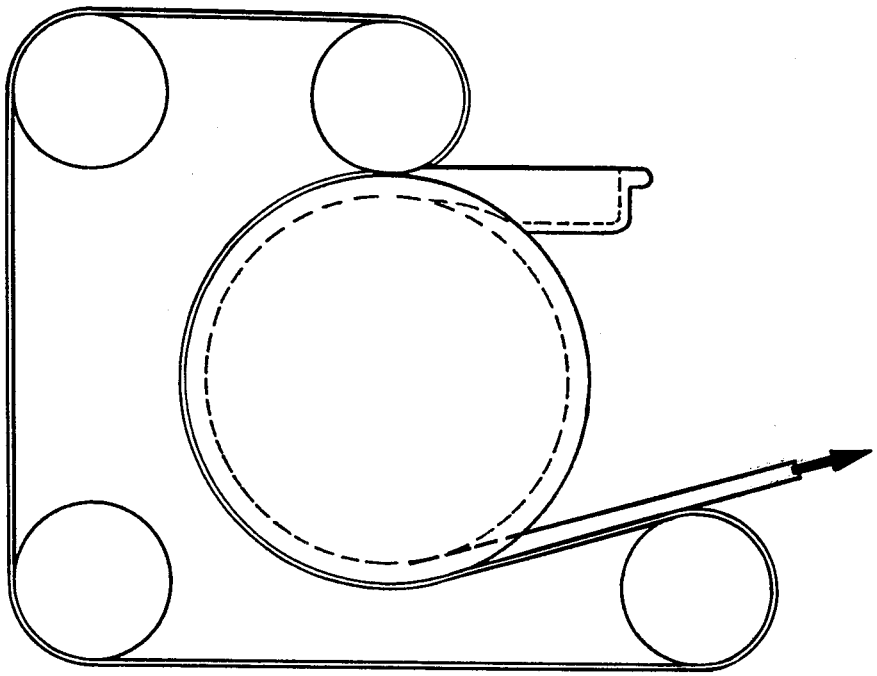
FIG. 4 PRIOR ART

FIG. 3 shows a four-wheel machine as in the French Pat. No. 1,178,580 to Pechiney which is specially designed for the casting of sheet billets; and FIG. 4 shows a machine comprising five wheels, as in U.S. Pat. No. 3,416,594 of Gyongyos.

Figure 5:
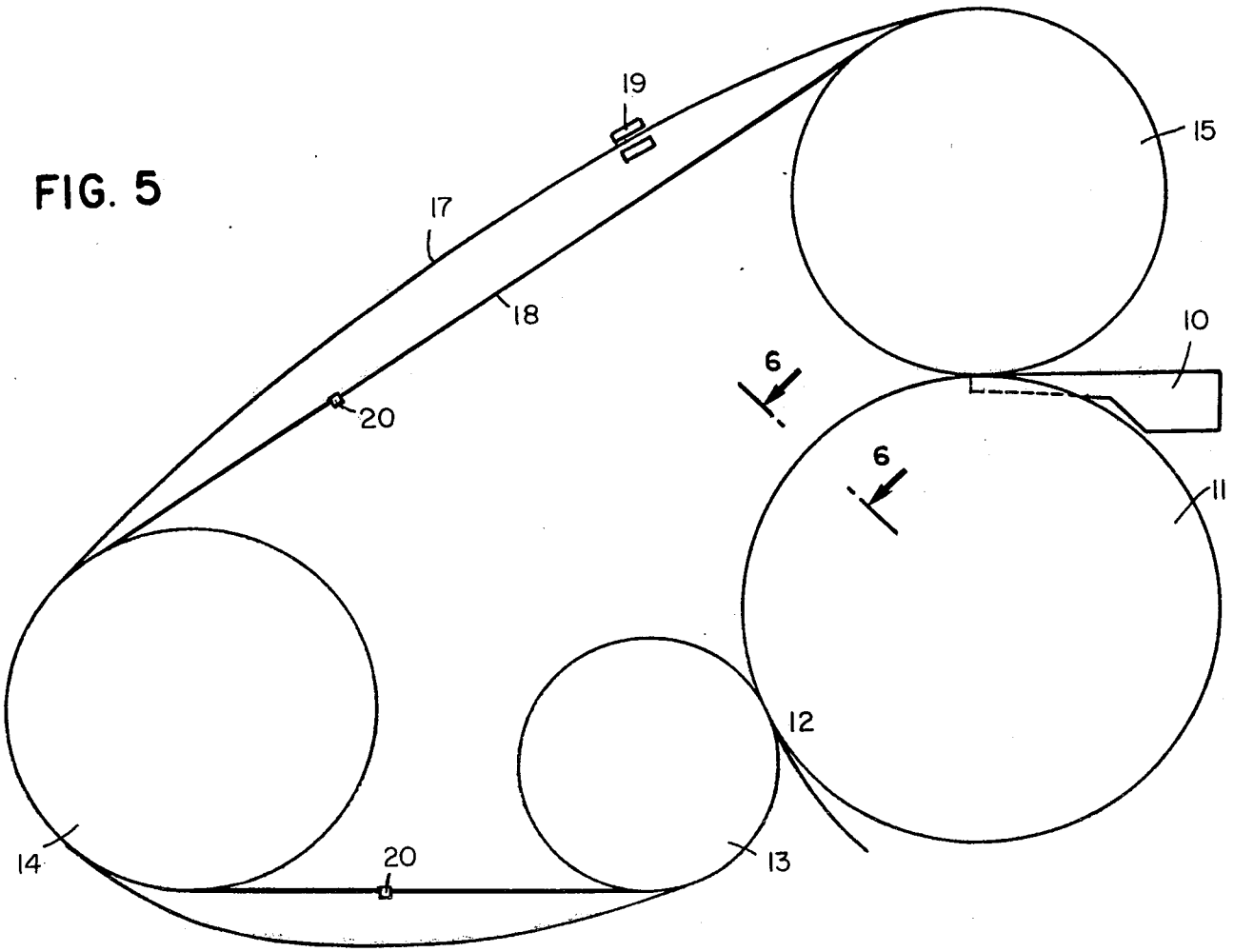

FIGS. 5 through 8 illustrate the present invention, wherein:

FIG. 5 illustrates the general layout of the casting machine in schematic form.

Figure 6:
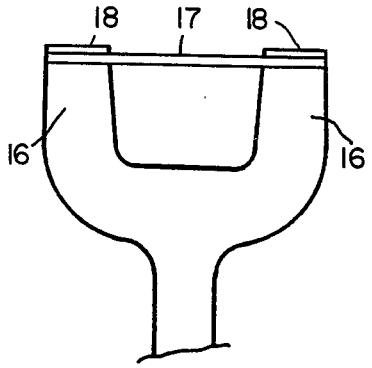
Figure 7:
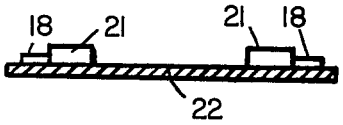
Figure 8:
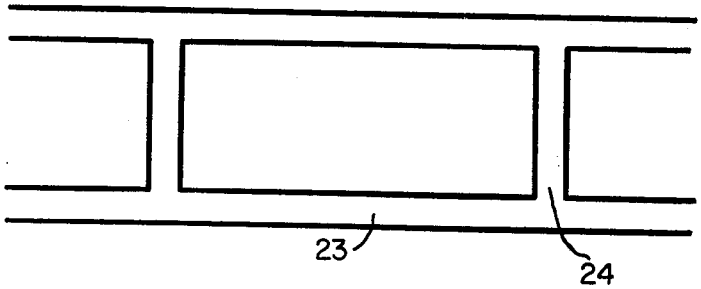

FIG. 6 is a cross-section of the casting wheel taken along line 6—6 of FIG. 5;

FIG. 7 is an end view showing the strap in section of the guide means and;

FIG. 8 is a plan view of a portion of the steel bands of the invention showing the spacing members.

Figure 1:
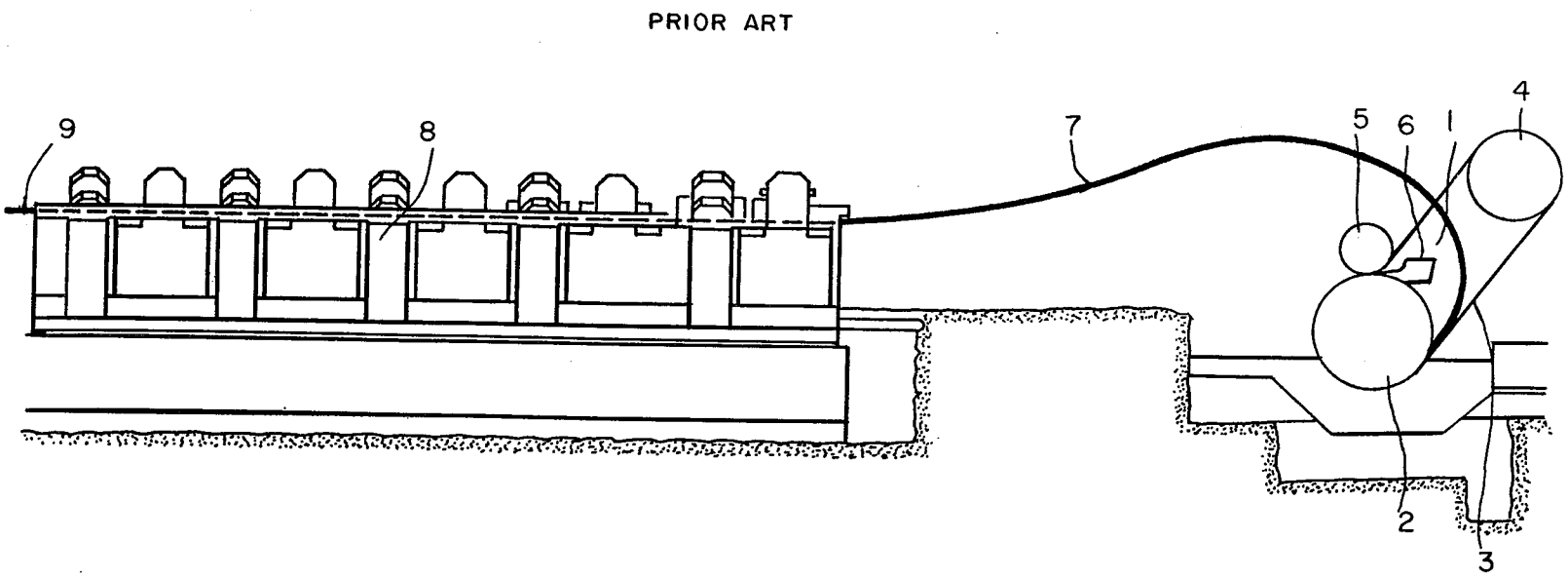
FIG. 1 PRIOR ART
FIG. 1 illustrates a casting machine provided with two wheels and one roller.
Figure 2:
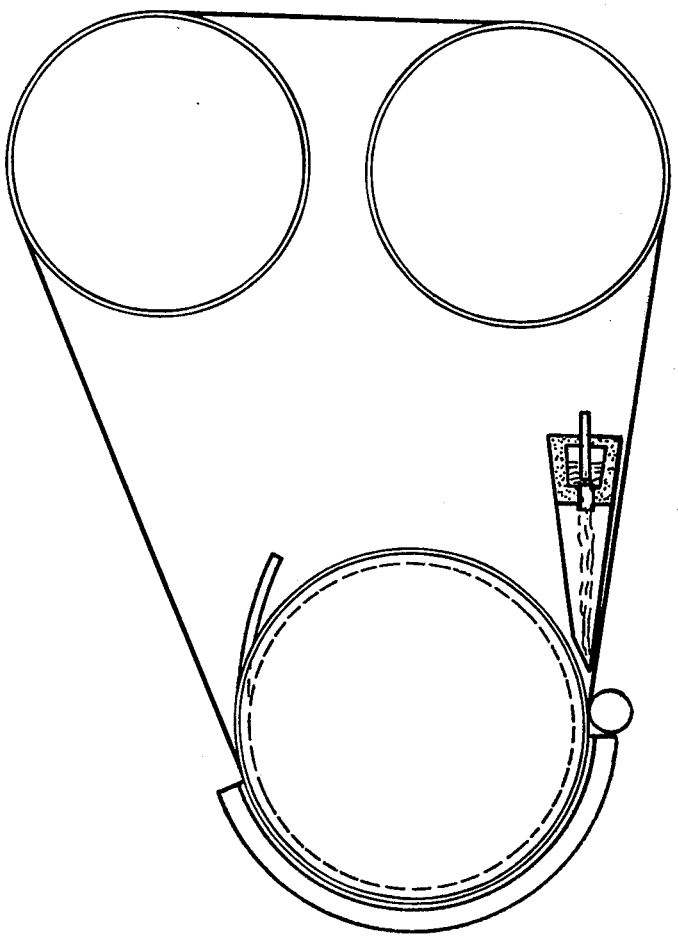
PRIOR ART FIG. 2
FIG. 2 shows a machine comprising three wheels as in British Pat. No. 1,143,264 to Properzi.

In FIG. 1, reference 1 denotes the casting machine consisting of a casting wheel 2 covered by a band 3. A second wheel 4 enables the band to be placed under tension. A roller 5 brings the band covering the wheel into the vicinity of the casting zone. The liquid metal is poured in at 6 and, on leaving the wheel, the cast blank 7 is guided towards a train of rollers 8 which convert it into machine wire 9. The cross-sectional area of the blank which is generally trapezoidal in shape varies according to the installations from 900 $mm^2$ to more than 3000 $mm^2$. The machine wire obtained generally has a diameter of 7.5 mm or 9.5 mm.

It is also possible under the same principle to cast sheet billets ranging for example from 15 to 30 mm in thickness and from 200 to 400 mm in width which are subsequently hotrolled and then cold rolled in the line for forming bands intended, for example, for the manufacture of slugs (so-called pawns) for impact extrusion.

These machines vary fairly widely in their configuration according to the number of auxiliary wheels and the positions of the inlet and outlet for the cast metal.

Naturally, the wheel and the band have to be intensively cooled with water, the wheel being cooled by various sprinkling, circulation and spraying systems, and the band by the direct projection of small jets of water.

In most cases, the casting wheel of these machines is made of pure copper or of low-alloyed copper because this material which is a good conductor of heat, ensures that the blank is cooled as quickly as possible. The band is generally made of ordinary steel. The choice of this material is dictated by a certain number of advantageous characteristics for this application, including low cost, ease of assembly by straightforward welding, and high mechanical strength which ensures minimal elongation in operation. On the other hand, ordinary steel has one disadvantage for this particular application, namely, its thermal conductivity which is relatively low compared with that of copper. For some time, this disadvantage was not felt because originally the casting wheels described above were used above all for casting nonalloyed aluminum or low-alloyed alloys: blanks for conductive wires of $A_4/L$, $A_5/L$ or A-GS/L, blanks for sheet billets of $A_4$, $A_5$ or low alloyed alloys such as 300 ($A\text{-}M_1$) or alloys of low magnesium content.

These alloys of aluminum and those noted in the next paragraph are designated in accordance with the French AFNOR symbols. Their equivalents in the American ASTM designations are as follows:

| AFNOR | | ASTM |
|---|---|---|
| $A_4/L$ | = | 1100 for electrical use |
| $A_5/L$ | = | 1050 for electrical use |
| A-GS/L | = | 6063 for electrical use |
| $A_4$ | = | 1100 |
| $A_5$ | = | 1050 |
| $A\text{-}M_1$ | = | 3003 |
| $A\text{-}U_4SG$ | = | 2014 |
| $AU_4G$ | = | 2024 |
| $A\text{-}Z_5GU$ | = | 7075 |

On the other hand, when more heavily alloyed alloys with a high solidification range of the 2000 or 7000 series, such as for example 2014 ($A\text{-}U_4SG$), 2024 ($A\text{-}U_4G$), 7075 ($A\text{-}Z_5GU$), are wheel-cast to obtain wire with high characteristics for mechanical rather than electrical applications, faults are observed on the side of the blank solidified in contact with the band. These faults are caused by the low level of heat exchanges through the band between the cast metal and the cooling water which results in refusion of the already solidified metal. These faults are aligned on the surface of the blank facing the band generally along two parallel lines. They resemble a series of slight swellings and exudations accompanied by segregations and porous zones. Now, during the subsequent rolling process, these defective zones have a tendency under the effect of hammering to develop cracks which remain intact up to the machine wire stage and render the metal unsuitable for the applications for which it was intended. Attempts have been made to replace the steel band by a band of copper or copper-containing alloy so that the cast product is surrounded over its entire periphery by a homogeneous mold of high thermal conductivity. However, pure copper cannot be used on account of its excessive ductility which, at low temperatures and to a greater extent at high temperatures, results in elongation and extremely rapid thinning of the strip used. Although the use of more heavily alloyed copper alloys with better mechanical properties, such as cuproberyllium, may be considered, the use of alloys such as these involves difficulties of supply and working (particularly welding), in addition to which their thermal conductivity is reduced in relation to that of pure copper.

We have developed a process which enables a band of pure copper to be used in casting machines of the type in question. This process consists in dissociating the two functions which are performed by the steel band in all the processes described above, namely the heat exchange function and the mechanical function: driving of the wheels and tension of the band on the wheels. It is preferred to use a band of copper for the first of these functions and a band of steel for the second function.

The invention consists in combining in one and the same machine a band of copper or of a metal which is a better conductor of heat than steel, which provides for the exchanges of heat between the blank and the cooling water and, preferably, two bands of steel which are responsible for applying the band of copper to the casting wheel and for driving the band of copper and the accessory wheels.

The casting machine illustrated in FIG. 5 is a four-wheel casting machine in which the molten metal is poured in through the casting channel 10 in the proximity of the upper generatrix of the casting wheel 11, although the position of the casting channel does not have any bearing upon the invention as described hereinafter. The invention is applicable both to a casting wheel fed by a vertical channel, and to a casting wheel fed by an oblique channel. The circumference of this wheel comprises a groove as shown in FIG. 6. The cast blank solidifies in the space delinited by this groove and the band which covers it, the wheel and the band being cooled with water. The solidified blank emerges at 12 where the band or bands leave the casting wheel following the escape wheel 13, then the return wheel 14, and finally the support wheel 15 which returns the band(s) into the casting zone. In the conventional process, the band is a single steel band which follows the path: casting wheel 11, escape wheel 13, return wheel 14, support wheel 15, as shown in the drawings, and which covers the entire blank, resting on the sides of the groove 16.

According to the present invention, there is used a copper band 17 and an assembly of two steel bands 18. The copper band is loose and is not subjected to tractive stresses at any point along its path. By contrast, the steel bands are placed under tension so as to apply the copper band to the wheel in the casting zone and to transmit the movement to the auxiliary wheels.

As shown in FIG. 6, the copper band covers the groove of the wheel and rests on the sides thereof. The two steel bands are tensioned parallel to one another. They cover the lateral parts of the copper band and apply them to the sides of the groove, as shown in FIG. 6, between the point at which the molten metal is introduced and the point at which the blank emerges. The copper band is therefore held firmly against the groove by these steel bands without itself being subjected to any tension. Apart from its contact with the casting wheel, it is loose. It is sufficient for it to be lightly held, for example between two lubricant-impregnated pads 19 disposed slightly ahead of the support wheel for guiding it and ensuring that it is correctly presented to that wheel. As shown in FIG. 6, the two steel bands apply the copper band to the sides of the groove. They are therefore parallel and must be kept at a constant distance apart over the entire path. Accordingly, it is necessary at various points to provide guide means for these two bands which keep them at a constant distance apart from one another. These guide means which are denoted by the reference 20 in FIG. 5 may be made for example in the extremely simple manner shown in section in FIG. 7. The steel bands 18 slide along stops 21 which are mounted on a support plate 22. These stops may be, for example, ball bearings to prevent any wear and tear along the sides of the steel bands.

It is also possible to use any other guide system.

This double-band arrangement enables the blank to be intensively cooled through the highly conductive copper band which is directly cooled by rows of water jets or sprays. By virtue of their arrangement, the steel bands never have to withstand any thermal stressing.

Experience has shown that the copper band which is not subjected to any tractive forces only undergoes heating during its travel in contact with the casting wheel and that this heating is not sufficient to produce any troublesome deformation for operation on an industrial scale.

The metallurgical quality of the cast blank is considerably improved, particularly in the case of alloys. The faults associated with the irregularities of solidification on the band side disappear completely not only under visual examination but also when examined by micrography or liquation. In addition, subsequent rolling to the diameter of the machine wire does not cause any cracks to appear, irrespective of the alloy used.

The arrangement which has just been described is also applicable to any casting system comprising any number of wheels in which the casting wheel is outside the loop formed by the band such as illustrated in FIG. 4 for example. However, it is also applicable to casting machines in which the casting machine is inside the loop formed by the band. The only difference is that, in this case, the copper band will be inside the loop whereas, in the other machines, it is outside the loop. Also, it is not absolutely essential for the copper band to follow exactly the same path as the steel bands and to travel over the same rollers. This is by no means a condition of the invention. For example, referring to FIG. 5, it is readily possible to construct a wheel in which the steel bands travel directly from the escape wheel 13 to the support wheel 15 without passing over the return wheel 14, the copper band continuing the complete circuit which was defined above.

Finally, the entire description has referred thus far to a band of pure copper. It is obvious that the use of a band of a more or less alloyed copper alloy or a band of aluminum alloy for casting metals of low melting points also falls within the scope of the invention. However, from both the technical and the economic point of view, the invention is of advantage above all in the case of a band made of a highly conductive material which is easy to braze or solder.

For keeping the steel bands parallel to one another, it is possible to join them at spaced intervals by means of spacer members, i.e., to use a steel band such as illustrated in FIG. 8 in which the references 23 denote the two parts of the band which apply the copper band to the sides of the groove while the center of the band is liberally perforated so as to enable the copper band to be directly cooled except at those places where the spacers 24 have been left. Although possible, this arrangement is less advantageous than the arrangement comprising two independent bands because, due to the presence of the spacers 24 it introduces fluctuations into the cooling conditions.

The arrangement described above may be applied not only to the production of trapezoidal blanks for the production of machine wire, such as illustrated in FIG. 6, but also to the production of sheet billets for the production of bands. In addition, although this arrangement is of particular interest for aluminum alloys of the 2000 and 7000 series, it may be applied to any aluminum alloys and also to numerous metals not only more fusible than alumium, such as zinc and lead, but also less fusible such as copper and its alloys.

We claim:

1. A rotary casting machine for casting semi-finished blanks of indefinite length of metal alloys, comprising:

(a) a rotatable casting wheel having a circumferential groove therein;

(b) endless band means adapted to travel at the same linear speed as the casting wheel circumference, and covering a portion of the wheel periphery so as to form with said groove an ingot mold for receiving molten metal;

(c) said band means including a main band formed of a metal having heat conducting properties greater than steel which contacts the casting wheel and a pair of parallel steel bands adapted to be placed under tension and bearing on the lateral sides of the main band on either side of said groove; and (d) auxiliary wheel means about which said band means passes to place said steel bands under tension wherein said main band is subjected to little or no tensile stressing.

2. A rotary casting machine as defined in claim 1 wherein said main band is made of copper.

3. A rotary casting machine as defined in claim 1 wherein said auxiliary wheel means includes a support wheel preceding said casting wheel and further including a pair of lubricant applying pads, said main band passing through said pads prior to passage over said support wheel.

4. A rotary casting machine as defined in claim 3 wherein said parallel steel bands are maintained in proper spaced relation by cross bar means spaced along the length of said bands.

* * * * *